United States Patent [19]

Muga

[11] Patent Number: 4,458,149

[45] Date of Patent: Jul. 3, 1984

[54] TIME-OF-FLIGHT MASS SPECTROMETER

[75] Inventor: M. Luis Muga, Gainesville, Fla.

[73] Assignee: Patrick Luis Muga, Gainesville, Fla.

[21] Appl. No.: 283,359

[22] Filed: Jul. 14, 1981

[51] Int. Cl.[3] ..... H01J 49/40

[52] U.S. Cl. ..... 250/287; 250/286

[58] Field of Search ..... 250/287, 286, 281, 282, 250/283

[56] References Cited

U.S. PATENT DOCUMENTS

| | | | |
|---|---|---|---|
| 2,642,535 | 10/1946 | Schroeder | 250/287 |
| 2,648,009 | 8/1953 | Robinson | 250/287 |
| 2,685,035 | 7/1954 | Wiley | 250/287 |
| 2,758,214 | 8/1956 | Glenn, Jr. | 250/287 |
| 2,784,317 | 3/1957 | Robinson | 250/287 |
| 2,790,080 | 4/1957 | Wells | 250/287 |
| 2,839,687 | 6/1958 | Wiley | 250/287 |
| 3,296,434 | 1/1967 | Studier | 250/287 |
| 3,582,648 | 6/1971 | Anderson et al. | 250/287 |
| 3,727,047 | 4/1973 | Janes | 250/287 |
| 3,953,732 | 4/1976 | Oron et al. | 250/287 |

OTHER PUBLICATIONS

Goudsmit, "A Time-of-Flight Mass Spectrometer", Phys. Rev 74, pp. 622-623, 1948.

Marable, N. L. and Sanzone G., Int. J. Mass Spectr. and Ion Phys., 13, 185 (1974), "High-Resolution Time-of-Flight Mass Spectrometry Theory of the Impulse-Focused Time-of-Flight Mass Spectrometer".

Browder, J. A., Miller, R. L., Thomas, W. A. and Sanzone, G., Int. J. Mass Spectr. and Ion Phys. 37, 99 (1981), "High-Resolution of Mass Spectrometry: II Experimental Confirmation of Impulse-Field Focusing Theory".

Carrico, J. P., Ferguson, L. D. and Mueller, R. K., Appl. Phys. Lett., 17, 146 (1970), "Time of Flight of Ions in an Inhomogeneous Oscillatory Electric Field".

Bakker, J. M. B., J. Phys. E; Sci. Instr. 6, 785 (1973), "A Beam Modulated Time-of-Flight Mass Spectrometer, Part I: Theoretical Considerations".

Bakker, J. M. B., J. Phys. E; Sci. Instr. 7, 364 (1974), "A Beam-Modulated Time-of-Flight Mass Spectrometer, Part II: Experimental Work".

Bronshtein, A. M. and Rafalson, A. E., Soviet Phys.-Tech. Phys., 16, 624 (1971), "Mass Spectrometer with Ion Separation by Time of Flight in a Retarding Electric Field".

Karataev, V. I., Mamyrin, B. A. and Shmikk, D. V., Soviet Phys.-Tech. Phys. 16, 1177 (1972), "New Method for Focusing Ion Bunches in Time-of-Flight Mass Spectrometers".

(List continued on next page.)

*Primary Examiner*—Alfred E. Smith
*Assistant Examiner*—Carolyn E. Fields
*Attorney, Agent, or Firm*—Arthur G. Yeager; Earl L. Tyner

[57] ABSTRACT

An improved pulsed-beam time-of-flight mass spectrometer is described whereby the velocities of a plurality of iso-mass ions are equalized (velocity compaction) by subjecting a transiting ion bunch, partially separated into iso-mass ion packets, to a time-dependent and monotonically time-varying acceleration force field. Concurrently, space compaction or space focussing is achieved through a speeding up of the retarded ions (relative to the advanced ions) in a given iso-mass ion packet. The wave-form of the ion accelerating field may be of an exponential-limiting-like form in time and depends on the various physical and voltage parameters associated with the ion source, accelerating grids and ion drift distances. When the acceleration force field is properly contoured in both space and time velocity compaction and space compaction simultaneously are achieved for a wide range of iso-mass ion packets and the mass resolution for heavier mass ions is particularly improved. The inherent sensitivity of this instrument for heavy mass ion detection is retained and the interval spacing of arrival times is more nearly uniform than in current time-of-flight mass spectrometers using constant voltage acceleration fields.

10 Claims, 4 Drawing Figures

OTHER PUBLICATIONS

Mamyrin, B. A., Karataev, V. I., Shmikk, D. V. and Zagulin, V. A., Sov. Phys.-JETP, 37, 45 (1973), "The Mass-Reflection, a New Nonmagnetic Time-of-Flight Mass Spectrometer with High Resolution".

Wiley, W. C. and McLaren, I. H., Rev. Sci. Instr., 26, 1150 (1955), "Time-of-Flight Mass Spectrometer with Improved Resolution".

Studier, M. H., Rev. Sci. Instr., 34, 1367 (1963), "Continuous Ion Source for a Time-of-Flight Mass Spectrometer".

Sanzone, G., Rev. Sci. Instr. 41, 741 (1970), "Energy Resolution of the Conventional Time-of-Flight Mass Spectrometer".

TIME-OF-FLIGHT MASS SPECTROMETER

This invention relates to an improved apparatus for and methods of distinguishing between ions of different mass by means of time-of-flight difference over a predetermined flight distance. In particular, the invention uses a time-dependent and time-varying acceleration field for achieving during flight a compaction, both velocity-wise and space-wise, of ions of like mass in order to enhance their separation from ions of different mass. The invention is especially adapted to provide a sharper differentiation between ions of almost identical mass while maintaining the high inherent sensitivity of time-of-flight methods for detecting heavy mass ions.

INTRODUCTION

The basic components of a pulsed-beam time-of-flight mass spectrometer are a source of ions, a means for extracting a tightly packed bunch of these ions, a main accelerating region followed by a field-free drift distance and finally, an ion detector, all positioned respectively, in the above named order along the ion flight path and housed in an evacuated tube. With a circular aperture to define the cross-sectional area of the extracted ion bunch, the different mass ions, in moving along their flight path, are stratified into thin disc-shaped ion packets, each with different mass-to-charge ratio m/q. Impact with the detector occurs at different times, corresponding to different m/q values (the lighter mass packets arriving earlier and followed by packets of successively heavier mass), and serves as the basis of mass identification. In this type of spectrometer a direct measurement is made of the corresponding flight time.

A second type of mass spectrometer uses a rapidly changing (radio frequency) acceleration field acting on the transiting ions. This type accepts or passes through ions of a particular velocity (and hence, unique mass) while rejecting ions of faster and slower velocities. It is more appropriately named a velocity filter as direct measurement of the flight time is not required. This type of spectrometer is not generally considered here.

In large part, the utility of a time-of-flight mass spectrometer depends upon its resolving power, or mass resolution, which is a measure of how well the spectrometer is able to discern different m/q ion groups on the basis of their arrival times. If all ions were formed in a plane perpendicular to the flight path and with zero initial velocity then the flight time would be the same for all ions having the same m/q value; the ability to resolve ions (of unit charge) of different mass would be limited only by the time response of the detecting system. In practice, the mass resolving power of a time-of-flight spectrometer depends on its ability to reduce the arrival-time spread caused by the ever-present initial space and initial velocity (i.e. kinetic energy) distributions.

The process by which the spectrometer attempts to resolve masses despite the initial space distribution is termed space focussing, while its reduction of the time spread introduced by the initial velocity distribution is termed velocity or energy focussing. A great deal of thought and effort have gone into attempts to improve both space and velocity focussing in order to minimize the dispersion in arrival times of ions with a given m/q value. Generally, these attempts use one or more of the following approaches: (1) reconfiguration of the ion source and extraction means, (2) redesign of the main acceleration stage and drift distance, (3) utilization of non-linear flight paths, and (4) improved electronics.

It is therefore the object of the present invention to provide a redesigned main acceleration stage, and mode of operation thereof, in order to improve the mass resolution and increase the sensitivity of detection.

It is also an object of the present invention to provide a novel method by which simultaneous energy and space focussing is achieved.

It is another object of the present invention to provide a means for achieving energy and space focussing which is independent of the type of ion source used to generate ion pulses.

It is another object of this invention to provide a means for operating a redesigned acceleration stage which can be used with a variety of types of pulsed ion sources.

Further, it is an object of this invention to provide a means for attaining improved mass resolution compatible with larger aperture ion sources, thereby increasing detection sensitivity.

Moreover, it is the object of this invention to differentially accelerate the iso-mass ion packets in such a manner that the heavier mass packets arrive at the detector in a more uniformly spaced (in time) manner than is obtained with current time-of-flight mass spectrometers that use constant voltage acceleration fields.

It is also the object of this invention to provide a means of simultaneous energy and space focussing which can be multiply applied, in tandem fashion, to the same ion bunches along their flight paths in order to achieve significantly higher mass resolution with little or no loss in sensitivity of detection.

These and other objects of the present invention will become more apparent as the detailed description proceeds.

DESCRIPTION OF NEW INVENTION

In general, the present invention comprises the steps of applying a time-dependent and time-varying force field to already partially separated iso-mass ion packets along their flight path. The varying force field or ion acceleration field is obtained by application, to a grid system, of a smoothly varying, monotonically changing voltage difference adjusted in such a manner that the slower moving ions receive a greater acceleration than faster moving ions, in consequence of which, ions within a given iso-mass packet are compacted velocity wise, i.e. they emerge from the varying acceleration region with near equal velocities. Simultaneously, ions at the advanced or leading edge of the iso-mass packet receive a lesser acceleration than ions at the retarded or trailing edge, as a consequence of which, the ions within a given iso-mass packet are compacted space wise during a subsequent drift period as the trailing ions catch up to the leading ions of an iso-mass packet. The two effects, velocity compaction and space compaction are simultaneously achieved on a wide range of ion mass packets during a given cycle of pulsed-beam operation.

Further understanding of the present invention will best be obtained from consideration of the accompanying drawings wherein.

VELOCITY COMPACTION

Figure 1:
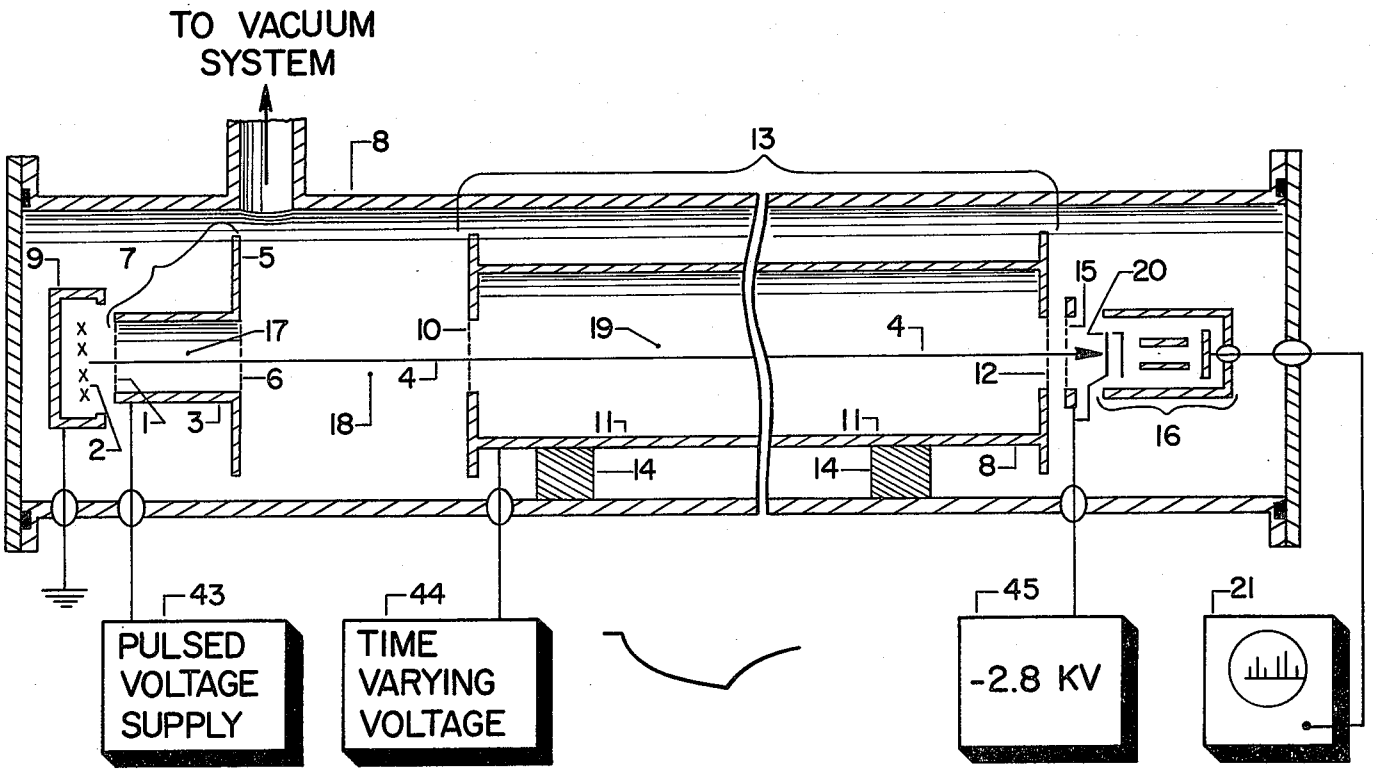
FIG. 1 is a highly schematic diagram of a longitudinal cross-section of a pulsed-beam time-of-flight mass spectrometer wherein the acceleration stage has been modified for achieving velocity and space compaction.

Consider a single cycle of operation in which a bunch of ions is formed in a pulsed ion source 9 and extracted from the ion source region 2 by the application of constant low value extraction voltage $V_x$ (ca negative ten volts) applied to the extraction grid 1, and accelerated into drift region 17. After initial partial separation into different iso-mass ion packets the ions enter varying acceleration region 18. Further consider two ions of identical mass entering region 18 at the same time but with different velocities, $v_1$ and $v_2$. Upon entering region 18 these ions experience a constantly increasing acceleration field due to the changing voltage V(t) applied to grid 10. The lower velocity ion will receive the larger acceleration over region 18 since the voltage will be larger by the time it arrives at grid 10. The condition for which the slower ion of a given mass will attain the same velocity as the faster one is given by the relation $$\frac{\Delta V(t)}{\Delta t} = \frac{V}{l}\sqrt{\frac{2q\,V_x}{m}} \tag{1}$$

provided $V_x$ is negligible compared to V. Here $\Delta V/\Delta t$ is the time rate at which the voltage is to be increased on grid 10 relative to second grid 6 during the passage of ions of mass m and charge q over the acceleration region 18 of length l.

Moreover, if the voltage V(t) is varied according to the relation $$V = \frac{V_o}{c}\,t^r \tag{2}$$

then velocity compaction will apply equally to all mass groups. Here, $V_o$ is the voltage applied at the time ions of mass 1 amu enter the accelerating region 18, and c and r are adjustable constants which depend on the extraction voltage $V_x$ and the distance between center of ion formation 2 and extraction grid 1 and the lengths of the first drift region 17 and acceleration region 18. Under these conditions all ions of a given mass, simultaneously entering region 18, will have the same velocity upon leaving region 18 and optimum velocity compaction will have been effected. Consequently, neglecting space focussing effects, the ion packet size for a given mass is maintained for the length of the drift region 19 until impact with detector 16.

SPACE COMPACTION

The same conditions (that provide for velocity compaction) also assure space compaction for a packet of iso-mass ions entering region 18. Consider two ions of the same mass and same velocity (but spaced apart along the flight dimension) entering region 18 at slightly different times $t_1$ and $t_2$. When the trailing ion enters the region 18 the accelerating field (provided by V(t)) is larger. Thus the trailing ion will receive a larger acceleration and, upon entering drift region 19, will begin to catch up with the leading ion. At some point 20, called the focus point, the trailing ions will overtake the leading ion. The drift distance over which this occurs is only slightly dependent on mass group and can be optimized by correct choice of parameters c and r as in the case of velocity compaction. The detecting stage 16 is placed at the end 20 of this length and is characterized by a final constant acceleration between grids 12 and 15 imposed by a large negative potential applied to grid 15, in order to increase all ion energies to sufficient value for efficient detection by the ion detector 16.

SPECIFIC EMBODIMENT OF INVENTION

Figure 2:
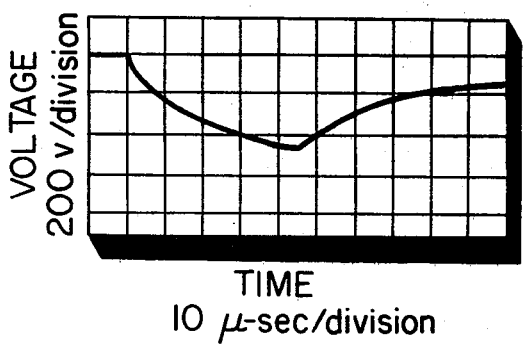
FIG. 2 is a representation of the time-varying acceleration voltage applied to the main acceleration grid 1 of the modified mass spectrometer of FIG. 1.
Figure 3:
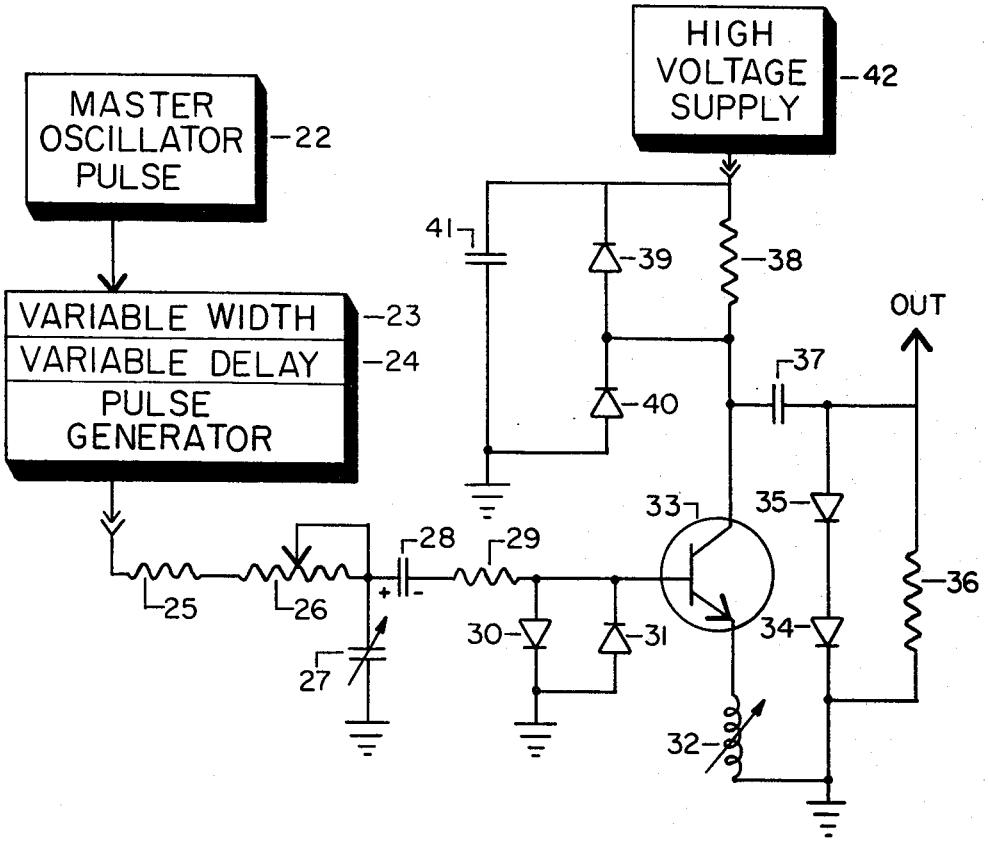
FIG. 3 is a schematic diagram of a typical electronic circuit which may be used for producing the time-varying acceleration voltage shown in FIG. 2.

In view of the principles outlined above and based on computer simulation studies, a Bendix Model '12' spectrometer having a 2 meter flight tube and manufactured by the Bendix Aviation Corporation has been modified as shown in FIGS. 1, 2, and 3. A drawout grid 1 with circular aperture of 1.27 cm diameter is located at 1 cm distance from the center of ion formation 2. The drawout grid 1 is affixed to the front end of a first drift tube 3 which is formed from a 2.54 cm inside diameter metal cylindrical shell of length 2 cm, positioned coaxially along the flight path 4, and which is capped on opposite end with a 7.6 cm diameter back plate 5 with second grid 6 with circular aperture and dimensions identical to those of the drawout grid 1. The second grid 6 is in electrical contact with the drawout grid 1 and first drift tube 3 and this assembly 7 is electrically insulated from the flight tube shroud 8 and ion source 9. At a distance of 8 cm from the second grid 6 is located a 7.6 cm diameter front plate with acceleration grid 10 of circular aperture of 1.27 cm diameter affixed to the front end of a second drift tube 11 fabricated from commercially available perforated sheet metal that is rolled into a cylindrical shape of inside diameter 6.5 cm and length 150 cm positioned coaxially with the flight trajectory 4 and capped at opposite end with a 7.6 cm diameter backing plate with fourth grid 12 of 1.27 cm diameter aperture. The fourth grid 12, second drift tube 11 and acceleration grid 10 are in electrical contact with each other and this assembly 13 is electrically insulated from the flight tube shroud 8 using ceramic spacers 14. At a distance of 0.5 cm from the fourth grid 12 is placed a fifth grid 15 and terminating the ion flight trajectory 4 is the front end 20 of the ion detector 16. The detector used in this apparatus may be any of a number of conventional ion detectors used for this purpose, an electron multiplier type of detector being commonly used.

In operation, a pulsed ion source 9 delivers a positive ion bunch which is extracted by a negative ten volts applied to the drawout grid 1 by means of voltage supply 43. Although the ion source used in this particular case was the original pulsed electron-impact-produced ion source, it is to be understood that any means of ion production coupled with means for pulsed drawout can be made compatible with this invention.

Passing through the drawout grid 1, the ions partially separate into iso-mass ion packets during flight in the first drift tube 3. Upon passing through the second grid 6, the ions experience a monotonically increasing acceleration field formed by the application of an exponentially-limiting-like negative voltage, as depicted by the trace drawing of FIG. 2, originating from voltage supply 44.

Equipment for producing the time-dependent and time-varying voltage shown in FIG. 2 may be built by persons skilled in the art in accordance with the circuit design and description published in *Electronics,* Vol. 38, No. 18, pg. 86, Sept. 6, 1965 by David O. Hansen.

Alternately, one may fabricate the circuit diagrammed in FIG. 3 for producing the accelerating voltage of FIG. 2.

The circuit of FIG. 3 contains the components described next.

| | |
|---|---|
| 25 Resistor, ½ watt | 100Ω |
| 26 Potentiometer, ½ watt | 0–500Ω |
| 27 Capacitor, variable, 15 volt | 0.001–0.1 μfd |
| 28 Capacitor, electrolytic, 15 volt | 10 μfd |
| 29 Resistor, ½ watt | 100Ω |
| 30,31 Diode, two | 1N627 |
| 32 Inductance, variable | 0.47–100 μh |
| 33 Transistor, high voltage switching | GE-259 |
| 34,35 Diode, two | 1N4005 |
| 36 Resistor, ½ watt | 1 MΩ |
| 37 Capacitor, 2000 watt | 0.0068 μfd |
| 38 Resistor, 20 watt | 45 KΩ |
| 39,40 Diode, high voltage, two | GE-CRI |
| 41 Capacitor, 2000 volt | 0.002 μfd |

The Bendix Model '12' Master Oscillator Pulser 22 is modified and adjusted to reduce the repetition frequency to 2.5 KHz. and the pulse therefrom serves to trigger a variable width 23 and variable delay 24 pulse generator which in turn delivers a square wave +5 volt signal that drives the high voltage switching circuit of FIG. 3.

By suitably adjusting (a) the variable width 23, (b) the variable delay 24, (c) the variable capacitor 27, (d) the variable inductance 32 and (e) the voltage output of the high voltage supply 42 (1500 volt maximum at 10 mA), the output voltage wave form (FIG. 2) can be optimally adjusted for achieving velocity and space compaction over a wide range of iso-mass ion packets during their transit of the accelerating region 18 and subsequent drift region 19. As shown specifically in FIG. 2 the wave form of the voltage output rises from zero volts at the beginning to about 500 volts over a time duration of about 50 microseconds.

A magnetic quadrupole lens (not shown) placed external to the vacuum shroud 8 in the post-acceleration vicinity is used to focus ions radially about the ion flight trajectory 4.

Thereafter, the ions receive a final acceleration by means of output from voltage supply 45 applied to the fifth grid 15 just prior to impact on the detector 16. The detector output serves as a record of the arrival time of the various iso-mass packets and may be easily viewed with an oscilloscope device 21 triggered by the master oscillator 22, as well as other more sophisticated permanent recording devices (not shown).

While the above description contains many specificities, these should not be construed as limitations on the scope of the invention, but rather as an exemplification of one preferred embodiment thereof. Many other variations and applications are possible, for example, velocity and space compaction may also be effected by impressing a time-dependent and time-varying deceleration field on transiting iso-mass ion packets. In this approach the leading and faster ions within a given iso-mass packet are decelerated more than retarded and slower ions.

An example of this embodiment would be as follows:

Drawout grid 1 of FIG. 1 is operated with a relatively high constant voltage (negative in value with respect to the ion source 9 if positive ions are to be extracted) of several hundred to a thousand volts derived from pulsed voltage supply 43. Accelerating region 18 is then operated as a decelerating field by applying to grid 10, by means of voltage supply 44, an exponential-decay-like voltage of decreasing value (i.e. increasing negative voltage) of the form given by eq. 2) with negative value for adjustable constant r. During each cycle of operation, a bunch of ions generated by pulsed ion source 9 is extracted by constant voltage applied to grid 1 from voltage supply 43. Passing grid 1, the bunch of ions separates partially into iso-mass ion packets during flight through post-extraction drift region 17. Passing grid 6, held at same high voltage as grid 1, the ions experience a decreasing-in-time retarding potential in region 18 as described above wherein the leading ions of an iso-mass ion packet are decelerated more than the lagging ions of like mass. During subsequent field-free drift in region 19 iso-mass ion packets distinctly separate from each other and, upon passing grid 12, ions are accelerated by a large negative voltage applied by means of voltage supply 45 to grid 15, thereby attaining sufficient velocities for efficient detection by detector assembly 16 as observed with oscilloscope 21 or other recording devices.

Figure 4:
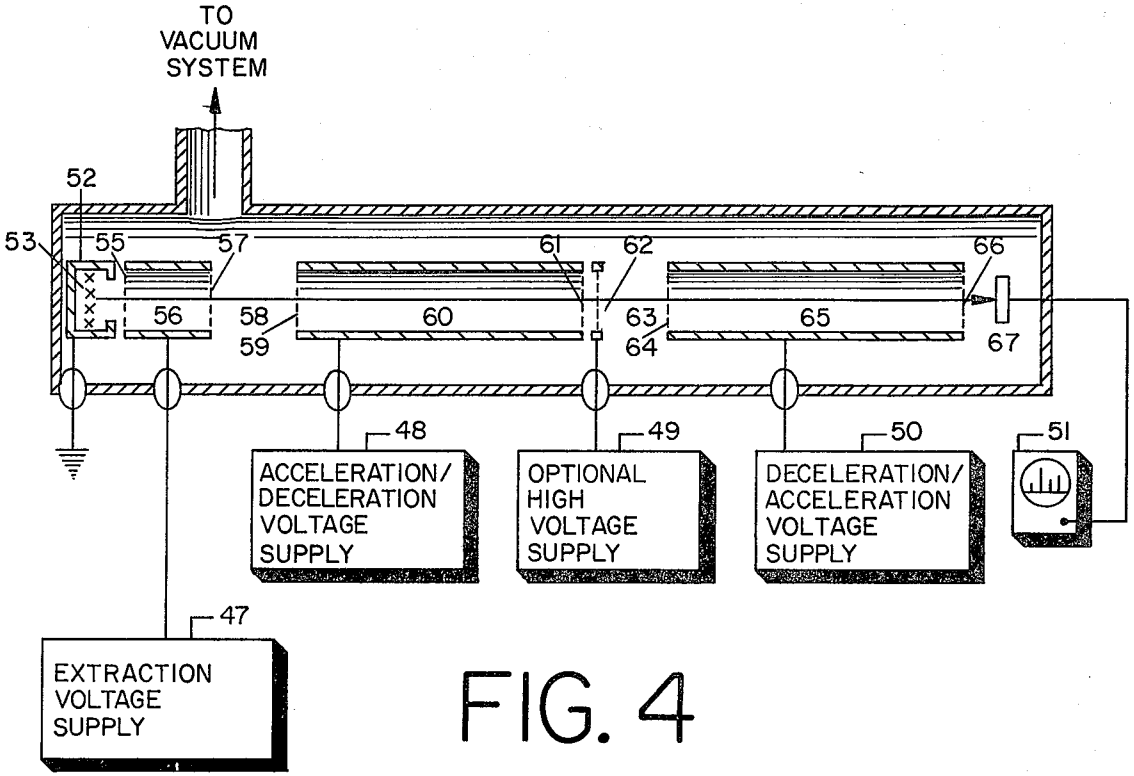
FIG. 4 is a schematic diagram of a cascaded two-stage velocity compaction time-of-flight mass spectrometer.

Moreover, a multiple stage (i.e. using tandem or cascaded sections) velocity compaction scheme can be envisaged, as shown in FIG. 4. For this case, during each cycle of operation, a positive ion bunch (53), formed in the center of the ion source (52), is extracted and passed into the first of two colinear, physically similar velocity compaction sections. The extracted ion bunch partially separates into iso-mass ion packets during a first field-free flight (56) and, the ions experience a velocity compaction acceleration in a first acceleration region (58) as provided for by the application of an exponential-limiting-like electro-magnetic acceleration field to this first acceleration region. During a second field-free drift (60), the iso-mass ion packets separate more distinctly from each other and then pass into a second acceleration field (63) where they experience a retarding potential field of exponential-decay-like function. Optionally, after ending second field-free drift, ions may first be accelerated by a constant high voltage applied to a grid (62) inserted between second field-free drift region and the second acceleration (retarding field) field region. The second acceleration (retarding field) field region is operated in a manner to achieve velocity compaction deceleration. In a final field-free drift region (65), iso-mass ion packets separate in still more distinct manner from each other and are accelerated toward a detector (67) upon which they impact and are observed by means of an oscilloscope or other recording device.

In an alternate two-stage version, ions are extracted at high potential, the first acceleration region is operated as an exponential decay-like retarding or deceleration field, and the second acceleration region is operated as an exponential-limiting-like acceleration field for achieving two-fold velocity compaction and two-fold space compaction of transiting iso-mass ion packets. Moreover, a multiple stage, i.e. more than two tandem or cascaded sections, velocity/space compaction scheme can be envisaged.

Accordingly, the scope of the protection afforded this invention should not be limited to the methods illustrated and described in detail above but shall be determined only in accordance with the appended claims and their legal equivalents.

For the purpose of interpreting this section, the following definitions shall apply:

Velocity compaction shall mean that process by which near equalization of velocities is effected for a plurality of iso-mass ions while said ions are transiting a region over which said process is implemented.

Space compaction shall mean that process by which retarded ions in a traveling packet containing a plurality of iso-mass ions are caused to catch up with and to overtake the advanced ions in this same packet at some predetermined point in flight.

The time-dependent nature of a function shall refer to that point in time at which the function is first applied relative to some starting point, in this case the start of the ion draw-out cycle.

The time-varying characteristic of a function shall refer to the functional change during a time period occurring after the initial time of application.

What is claimed is:

1. A pulsed-beam time-of-flight mass spectrometer having a vacuum housing, a pulsed ion source, an ion extraction means, an acceleration stage, a subsequent ion drift region and a detector, wherein the improvement comprises, as the acceleration stage:

(a) a pre-acceleration flight distance over which an extracted ion bunch passes and in so doing achieves partial separation into iso-mass ion packets; followed by (b) an ion acceleration region; and (c) a means for supplying, during each cycle of operation, a time-dependent and monotonically time-varying electromagnetic acceleration field over said acceleration region for achieving both velocity compaction and space compaction of a multiplicity of transiting ions of various masses, thereby resulting in improved mass resolution.

2. A pulsed-beam time-of-flight mass spectrometer of claim 1 wherein said extraction means and said acceleration stage includes:

(a) a time-dependent but constant low voltage extraction grid; in combination with (b) an ion acceleration region defined by the placement of an acceleration grid at a specific distance along the ion flight path in relation to the end of said pre-acceleration flight distance.

3. A pulsed-beam time-of-flight mass spectrometer of claim 2 wherein said extraction means and said acceleration stage includes:

(a) a first drift tube in which partial separation of the ion bunch into iso-mass ion packets occurs, said first drift tube, measuring 2.54 cm inside diameter and 2.0 cm length, following said extraction grid and in electrical contact with same and capped at opposite end by and in electrical contact with an identical second grid; in combination with (b) an acceleration grid forming a 1.27 cm diameter circular aperture, placed transverse to the ion flight path and located 8 cm from the capped end of said first drift tube; followed by and in combination with (c) a second drift tube measuring 6.5 cm inside diameter and 150 cm length, in electrical contact with said acceleration grid and capped by and in electrical contact with an identical fourth grid at opposite end, which end terminates 0.5 cm in front of a detecting assembly.

4. A pulsed-beam time-of-flight mass spectrometer having a vacuum housing, an ion source, an ion extraction means, an acceleration stage, an ion drift region and a detector, wherein the improvement comprises, as the acceleration stage:

(a) an initial flight distance over which an extracted ion bunch passes and in so doing achieves partial separation into iso-mass packets; followed by (b) an ion deceleration region; and (c) a means for supplying, during each cycle of operation, a time-dependent and monotonically time-varying electromagnetic deceleration field over said deceleration region for achieving both velocity compaction and space compaction of a plurality of transiting ions of various masses, thereby resulting in improved mass resolution.

5. A pulsed-beam time-of-flight mass spectrometer of claim 4 wherein said extraction means and said acceleration stage includes:

(a) a time-dependent but constant high negative voltage extraction grid for extracting said ion bunch as positive ions from the ion source; in combination with (b) a post-extraction flight distance over which the extracted ion bunch passes and in so doing achieves partial separation into iso-mass ion packets; followed by (c) an ion deceleration region defined by the placement of a deceleration grid at a specific distance along the ion flight path in relation to the end of said post-extraction flight distance.

6. An improved time-of-flight mass spectrometer wherein the improvement comprises a time-varying acceleration stage followed by and in combination with a time-varying deceleration stage assembled and described as follows:

(a) a pulsed source of ions; followed by (b) a low voltage extraction grid for drawing-out an ion bunch; followed by (c) a post-extraction region in which said ion bunch partially separates during flight into iso-mass ion packets each containing a plurality of ions; said iso-mass ion packets then entering (d) an acceleration region;

(e) a means for supplying, during each cycle of operation, a time-dependent, monotonically time-varying electric force field contoured in time and space over said acceleration region for achieving both velocity compaction and space compaction of said plurality of ions within each of said iso-mass ion packets;

(f) a post-acceleration region over which further separation in time and space of said iso-mass ion packets from each other occurs; followed by (g) a deceleration region;

(h) a means for supplying during said cycle of operation, a time-dependent, monotonically time-varying electric retarding force field contoured in time and space over said deceleration region for achieving both velocity compaction and space compaction of said plurality of ions within each of said iso-mass ion packets;

(i) a post-deceleration region over which still further and more distinct separation in time and space of said iso-mass ion packets from each other occurs; followed by (j) a means for detecting said ions; with items b,c,d,e,f,g,h, and i operated in tandem combination for achieving two-fold velocity compaction and two-fold space compaction of the pluralities of iso-mass ions derived from said extracted ion bunch, thereby resulting in improved mass resolution over current time-of-flight mass spectrometers.

7. An improved time-of-flight mass spectrometer of claim 6 which further comprises the insertion of a constant high voltage grid between the end of the post-acceleration region and the beginning of the deceleration region in order that said ions enter said deceleration region with approximately equal energies.

8. An improved time-of-flight mass spectrometer wherein the improvement comprises a time-varying deceleration stage followed by and in combination with a time-varying acceleration stage assembled and described as follows:

(a) a pulsed source of ions; followed by
(b) a high voltage extraction grid for drawing-out an ion bunch; followed by
(c) a post-extraction region in which said ion bunch partially separates during flight into iso-mass ion packets each containing a plurality of ions; said iso-mass ion packets then entering
(d) a deceleration region;
(e) a means for supplying during each cycle of operation, a time-dependent, monotonically time-varying electric retarding force field contoured in time and space over said deceleration region for achieving both velocity compaction and space compaction of said plurality of ions within each of said iso-mass ion packets;
(f) a post-deceleration region over which further separation in time and space and iso-mass ion packets from each other occurs; followed by
(g) an acceleration region;
(h) a means for supplying, during said cycle of operation, a time-dependent, monotonically time-varying electric force field contoured in time and space over said acceleration region for achieving both velocity compaction and space compaction of said plurality of ions within each of said iso-mass ion packets;
(i) a post-acceleration region over which still further and more distinct separation in time and space of said iso-mass ion packets from each other occurs; followed by
(j) a means for detecting said ions; with items b,c,d,e,f,g,h, and i operated in tandem combination for achieving two-fold velocity compaction and two-fold space compaction of the pluralities of iso-mass ions derived from said extracted ion bunch, thereby resulting in improved mass resolution over current time-of-flight mass spectrometers.

9. An improved method for mass analyzing chemical compounds in a pulsed-beam time-of-flight mass spectrometer, wherein the improvement comprises the following combination of steps:

(a) partially separating an extracted ion bunch containing a plurality of ions of various masses into iso-mass ion packets during flight over a post-extraction region; followed by
(b) selectively accelerating the transiting ions during passage over an acceleration region by exposing said ions in said iso-mass ion packets to an exponential-limiting-like electric accelerating field obtained by impressing upon an acceleration grid a smoothly varying, monotonically increasing voltage of the proper sign for accelerating said ions such that near equalization of velocities for ions of a given mass has occurred at the time said ions leave said acceleration region; followed by
(c) further separating said iso-mass ion packets from each other in time and space during subsequent flight over a post-acceleration distance prior to impact on an ion detector.

10. An improved method for mass analyzing chemical compounds in a pulsed-beam time-of-flight mass spectrometer, wherein the improvement comprises the following combination of steps:

(a) partially separating an extracted ion bunch containing a plurality of ions of various masses into iso-mass ion packets during flight over a post-extraction region; followed by
(b) selectively decelerating the transiting ions during passage over a deceleration region by exposing said ions in said iso-mass ion packets to an exponential-decay-like electric decelerating field obtained by impressing upon a deceleration grid a smoothly varying, monotonically decreasing voltage of the proper sign for decelerating said ions such that near equalization of velocities for ions of a given mass has occurred at the time said ions leave said deceleration region; followed by
(c) further separating said iso-mass ion packets from each other in time and space during subsequent flight over a post-deceleration distance prior to impact on an ion detector.

* * * * *